United States Patent [19]

Kaneko et al.

[11] Patent Number: 5,002,642

[45] Date of Patent: Mar. 26, 1991

[54] METHOD FOR ELECTROWINNING A METAL USING AN ELECTRODE UNIT CONSISTING OF ASSEMBLED ANODE PLATES AND CATHODE PLATES AND A FRAME BODY FOR FORMING SUCH AN ELECTRODE UNIT

[75] Inventors: Koichi Kaneko, Akita; Kiyotaka Abe, Kagawa; Takeo Kimura, Akita; Fusao Ichinoseki, Hoya; Mitsuru Ohkoda, Akita, all of Japan

[73] Assignee: Mitsubishi Kinzoku Kabushiki Kaisha, Tokyo, Japan

[21] Appl. No.: 179,543

[22] Filed: Apr. 8, 1988

[30] Foreign Application Priority Data

| | | | |
|---|---|---|---|
| Apr. 10, 1987 | [JP] | Japan | 62-87106 |
| Apr. 21, 1987 | [JP] | Japan | 62-96291 |
| Jul. 6, 1987 | [JP] | Japan | 62-166892 |

[51] Int. Cl.[5] ..... C25C 1/00; C25C 7/02; C25C 7/08

[52] U.S. Cl. ..... 204/105 R; 204/198; 204/225; 204/286; 204/288; 204/289; 204/297 R; 204/297 W

[58] Field of Search ..... 204/286, 288, 284, 105 R, 204/254, 268, 198, 297 R, 297 W, 225, 279, 280, 106, 114

[56] References Cited

U.S. PATENT DOCUMENTS

| | | | |
|---|---|---|---|
| 1,715,411 | 6/1924 | Cesare | 204/288 |
| 3,402,117 | 9/1968 | Evans | 204/288 |
| 3,579,431 | 5/1971 | Jasberg | 204/280 |
| 3,761,384 | 9/1973 | Ruthel et al. | 204/288 |
| 4,568,434 | 2/1986 | Morris et al. | 204/297 R |

*Primary Examiner*—John F. Niebling
*Assistant Examiner*—David G. Ryser
*Attorney, Agent, or Firm*—Oblon, Spivak, McClelland, Maier & Neustadt

[57] ABSTRACT

A method of electrowinning a metal in which electrolysis and servicing and treatments of the electrodes are carried out using an electrode unit. A plurality of anode plates and cathode plates are allunately and insulatedly assembled and regularly spaced and secured. By use of such electrode units, the anode plates and the cathode plates can be arranged closely-spaced, and thus the efficiency of electrolysis is enhanced, the electrolytic cell can be made compact, and the operation space can be reduced. Also, this method is suitable for automation of an electrowinning operation.

10 Claims, 9 Drawing Sheets

METHOD FOR ELECTROWINNING A METAL USING AN ELECTRODE UNIT CONSISTING OF ASSEMBLED ANODE PLATES AND CATHODE PLATES AND A FRAME BODY FOR FORMING SUCH AN ELECTRODE UNIT

FIELD OF THE INVENTION

This invention relates to a method for electrowinning and electrolytic refining of zinc, copper, and other metals which is efficient in electrolysis and enables electrode-handling operations such as immersing and lifting into and from an electrolytic cell and various treatments to be carried outeasily. The invention also relates to a frame body for assembling electrode plates. In this specification, the term "electrowinning" is hereinafter used as including "electrolytic refining."

BACKGROUND OF THE INVENTION

In the electrowinning of a metal, a plurality of cathode plates and anode plates are altenately arranged at equal intervals. Hitherto, cathode plates and anode plates have been hung in an electrolytic cell separately plate by plate, and use of an electrode unit consisting of assembled anode plates and cathode plates has not been known. The reason is that cathodes are used as mother plates on which an electrolyzed metal is deposited and recovered, while anode plates are merely used as electrodes, and it suffices if only cathode plates are taken out of the cell in order to recover the deposited metal.

When the cathode plates and anode plates are separately hung plate by plate in an electrolytic cell as has been done, the electrode plates are liable to swing and often contact each other, thereby causing electrical short circuiting. Therefore, a cathode and an anode are spaced apart at a considerably wide distance in comparison with the thickness of the metal to be deposited on the cathode surface. This makes the electrolytic cell larger and increases electric resistance, which invites inefficiency in electrolysis and increase in power consumption.

Of course, many attempts have been made in order to shorten the distance between the adjacent anode and cathode preventing short-circuiting. For example, rods of an insulating material have been placed in parallel at the bottom of the electrolytic cell, and the lower ends of the electrode plates have been inserted in the spaces between the rods in order to prevent swinging and contacting of the electrodes. However, it is not easy to insert the lower ends of the hanging electrode plates in the spaces between the rods, and even still the short-circuiting is not always perfectly prevented. This is because insertion of the electrode plates is not easy if the insulating rods are long enough, and the electrode plates tend to contact each other at end portions if the insulating rods are short. The anode plates are made of rather soft lead or lead alloy and, therefore, easily bend, which also may cause mutual contacting of electrodes at the edge portions although the central portions are separated. Also there is a danger that anode plates may be bent when they are inserted into the spaces between the insulating rods and cause contacting with the adjacent plate.

It is also known to provide the anode plates with insulating protrusions at the surface thereof to prevent contact with the cathode plates on which the object metal has been deposited. However, it is troublesome to produce anode plates provided with such protrusions, and even such anode plates cannot be stably set in the cell, nor are they free from bending. Thus, they are not practical.

In the conventional electrowinning of a metal, it is rather troublesome to remove only the cathode plates and return them to the cell after stripping the deposited metal. The cathode plates from which the deposited metal has been stripped off are to be inserted again each between the two adjacent anode plates in the electrolytic cell. The operators have to watch the suspended cathode plates and carefully adjust the positions of each cathode plate before they are actually inserted between the anode plates. This requires a considerably long time of operation even for experienced operators.

In the conventional electrowinning of a metal, there is also a problem in the treatment of the electrodes after the electrolysis. In the electrowinning of zinc, which is a typical example of electrowinning, the cathode plates are taken out from the electrolytic cell for stripping of deposited zinc every time one period operation of electrolysis is finished, and again they are immersed in the cell after they have undergone the stripping and other treatments. On the other hand, the anode plates are taken out of the cell after every several cycles of electrolysis for servicing, such as removal of crusts formed on the surface thereof. The crust formed on the anode surface increases the electrolysis resistance and deteriorates electrolysis efficiency. Therefore, it is desirable to remove the crust as frequently as possible. Hitherto, the treatment of the anode plates have been effected once per several times of cathode strippings. The reason is that the cathodes and the anodes are respectively hung plate by plate, and, therefore, it is troublesome to take out the alternately arranged and individually suspended cathodes and anodes separately and to return the two kinds of electrodes respectively to the original positions every time, which increases burden in operation.

OBJECTS OF THE INVENTION

One object of the present invention is to provide a method for electrowinning a metal comprising using at least one electrode unit which comprises a plurality of anode plates and cathode plates alternately, insulatedly and separably assembled.

Another object of the present invention is to provide a method for electrowinning a metal as described above, wherein immersion and lifting of the electrodes into and from an electrolytic cell and various treatments of the electrodes are carried out unit by unit.

Still another object of the present invention is to provide the method for electrowinning a metal generally as described above in which a series of procedures of lifting of the electrode plates from the electrolytic cell, electrode treatments, and immersing the electrodes again in the electrolytic cell are continuously carried out as the cathode plates and anode plates are simultaneously suspended by the transfer means.

Still another object of the present invention is to provide a method for electrowinning a metal generally as described above wherein the electrode unit is assembled by means of frame bodies, the unit is disassembled after the unit is lifted from the electrolytic cell, and, during and after transfer, the separated anode plates with frame bodies and cathode plates are simultaneously suspended and subjected to various treatments, whereafter the electrode plates are assembled again and immersed in the electrolytic cell as a unit.

Still another object of the present invention is to provide a method for electrowinning a metal generally as described above wherein the frame bodies are removed from the anode plates after the electrode units are lifted from the electrolytic cell, and they are fixed to the anodes before the electrode plates are assembled again.

Still another object of the present invention it to provide a frame body made of an electrically insulating material for forming an electrode unit, said frame body comprising two frames which constitute a frame body and hold an electrode plate, fixing members for holding an electrode plate, engaging member which engages with another frame body, and short-circuiting preventing members which prevent contacting of the crossbars of the electrodes.

Still another object of the present invention is to provide a frame body for forming an electrode unit generally as described above wherein the frame body is rectangular so as to encompass the outer edges of an anode plate, a plurality of the fixing members each of which comprises a pair of nail means are provided sandwiched between the two frames, and the engaging member is a pair of strips projected from the two side edges of one of the two frames extending toward an adjacent frame body to receive a cathode plate therebetween.

Still another object of the present invention is to provide a frame body for forming an electrode unit generally as described above wherein clearances are provided at part of the bottom periphery and side peripheries of the frames.

GENERAL DISCUSSION OF THE INVENTION

In the present invention, the term electrode unit means an assembly of a plurality of anode plates and cathode plates which are alternately, insulatedly and separably arranged, the means for assembling not being concerned. The simplest form of the electrode unit is an assembly of a plurality of alternately arranged and mutually insulated anode plates and cathode plates with small spaces therebetween to be immersed in an electrolytic cell. For assembling the anode and cathode plates, various measures can be resorted to. That is, anode plates and cathode plates can be assembled by holding them alternately by means of a pair of connecting members with spacedly arranged insulating spacers, whereby a pair of connector members simultaneously functions as insulators and/or spacers. Frames of various shapes and structures can be used if they can hold the anode and cathode plates alternately with spaces therebetween. For example, an insulating frame can be individually fixed to an anode plate, which can engage with an adjacent frame by means of engaging members provided thereon, or a three-dimensional frame which can contain a plurality of anode and cathode plates which are alternately arranged with spaces therebetween, etc. can be used.

A specific example of such a frame is a frame body which comprises a pair of rectangular frames which can encompass an electrode and which are provided with anode-fixing members, engaging members which engages with another adjacent frame body, and short-circuiting preventing members which prevent contacting of the cross bars. The anode-fixing member is a clip means comprising a pair of nail-like members which hold peripheries of an anode, and a plurality of them are attached to the vertical beams of the frames sandwiched therebetween projecting inward at the symmetrical positions. The anode-fixing members are also provided in the bottom beams of the frame bodies. The engaging member is a pair of strips each projected from one edge of one the two frames extending toward an adjacent frame body to receive a cathode plate therebetween. Frame bodies respectively hold an anode plate and are alternately arranged with cathode plates and connected to form an electrode unit, wherein the frame bodies work as spacers.

In the thus formed electrode unit, as the anode plates and cathode plates are fixed by spacers or frame bodies, they are free from contacting caused by swinging. Therefore, the space between an anode and a cathode can be designed far smaller than the conventional design. Although the space between an anode and a cathode can be made smaller by reducing the thickness of the spacer or the frame, the space cannot be made excessively small, the thickness of the metal to be deposited is restricted. Thin deposited metal is not easy to strip off. Therefore, the space is suitably selected by considering the species of metal to be deposited, the conditions of electrolysis, etc.

An electrode unit is immersed in an electrolytic cell, as is, for electrolysis, and it is lifted after the electrolysis. The unit which has been lifted is subjected to various treatments before it is immersed in an electrolytic cell again. The treatments which the electrodes undergoes are different in accordance with the structure of the electrode unit. Whatever treatments electrodes undergo, if the electrodes are assembled into a unit and if the unit is used in the electrolysis, such processes belong to the present invention.

After the electrode unit is lifted from an electrolytic cell, the cathode plates and anode plates are subjected to various treatments including stripping of the deposited metal without being separated into the anode group and the cathode group. Therefore, the anodes and cathodes are again simultaneously returned to the electrolysis step.

That is, stripping of the deposited metal and servicing of the electrode plate are carried out unit by unit. The modes of the electrode unit include various embodiments.

When an electrode unit is formed by means of the above-mentioned spacer-clamps means or a three-dimensional frame, the spacer-clamp means or three-dimensional frame are removed when the electrode plates are transferred to various treatment stations as suspended from a transfer means. Thereafter the electrodes are assembled again by the clamp-spacers or the frame for reimmersion into the electrolytic cell.

When an electrode unit is formed by means of frame means of an insulating material respectively fixed to an electrode, which are connected to each adjacent frame body, the connected frame bodies are disconnected after the unit is lifted from the electrolytic cell, and the electrode plates are subjected to various treatments as suspended from a transfer means without removing frame bodies. After the treatments have been finished, the electrode are reassembled to a unit, and they are then immersed in an electrolytic cell. In some cases, the frame bodies are removed from the anode plates if required.

In either case, the anode plates and the cathode plates are subjected to various electrode treatments including stripping of the deposited metal, washing, and servicing of the electrodes, etc. as they are suspended from a transfer means such as an overhead crane.

The electrodes released from the frame means or spacers are too closely located to carry out various treatments of the electrodes. In practicing the present invention, it is preferred to use a transfer means which can space apart the electrodes and then bring them together. Such a transfer means is disclosed in the copending patent application filed by the same assignee on the same date as this application (application Ser. No. 07/179,402 now U.S. Pat. No. 4,851,098).

As mentioned above, in the method of the present invention, the inter-electrode space can be made remarkably small. For example, in the electrode unit used for the electrowinning of zinc, the distance between the surface of the adjacent anode plate and cathode plate can be as close as about 14 mm, in contrast with about 30–35 mm in conventional processes. That it, the space can be reduced by about ½. This means reduction in electrolysis resistance i.e. reduction in power consumption. Further, the electrolytic cell can be made more compact, which means reduction of the operation space.

By the employment of an electrode unit, handling of the electrodes is simplified, and operation efficiency is improved. Stripping of deposited metal, washing, and other treatments are carried out unit, by unit and it is suitable to automate a series of operations from electrolysis to treatments of electrodes.

In the method of the present invention, the anode plates and the cathode plates on which the object metal has been deposited are simultaneously lifted as a unit as the electric current is retained in contrast with the conventional method in which the anode plates and cathode plates are lifted separately. Moreover the electrodes can be continuously treated while suspended from a transfer means. Therefore, the operation can be carried out more rapidly than conventional methods.

By employing an anode servicing apparatus and a cathode washing apparatus as described hereinafter in the specific description, these treatments can be continuously carried out while the electrodes are carried.

In conventional methods, stock conveyers are required for treatment of the electrodes. This is because the electrodes are individually suspended, and they have to be transferred to each treatment station one by one. Installment of stock conveyers requires a larger plant space. The present invention has eliminated the necessity of a stock conveyer because the electrodes of the different kinds can be simultaneously treated, and thus a series of treatments of the electrodes plates can be effectively carried out in a relatively small housing.

A plurality of electrode plates can be simultaneously treated while suspended from a transfer means, which means higher operation efficiency is achieved.

DESCRIPTION OF PREFERRED EMBODIMENTS

Figure 1A:
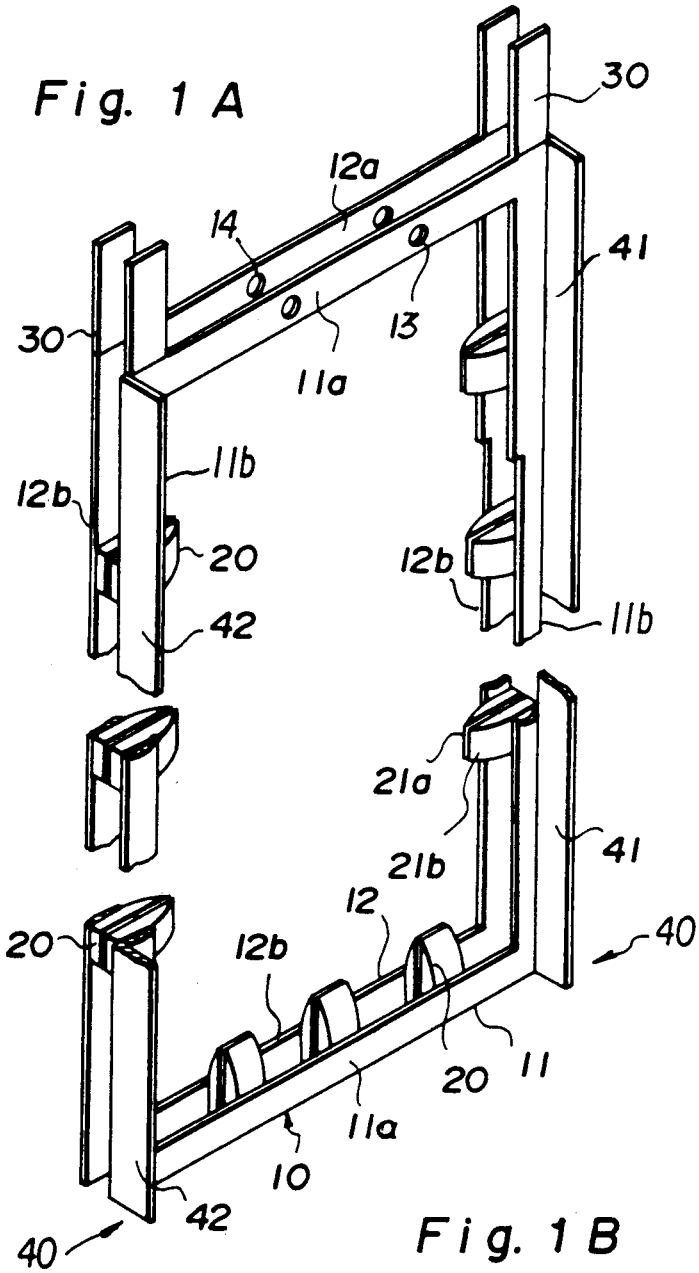
FIG. 1A is a partially cut-off perspective view of a frame body used in the present invention.
Figure 1B:
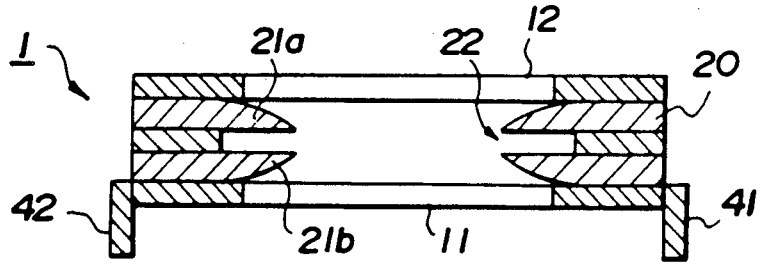
FIG. 1B is a schematic horizontal cross-sectional view of the frame body shown in FIG. 1A.
Figure 2:
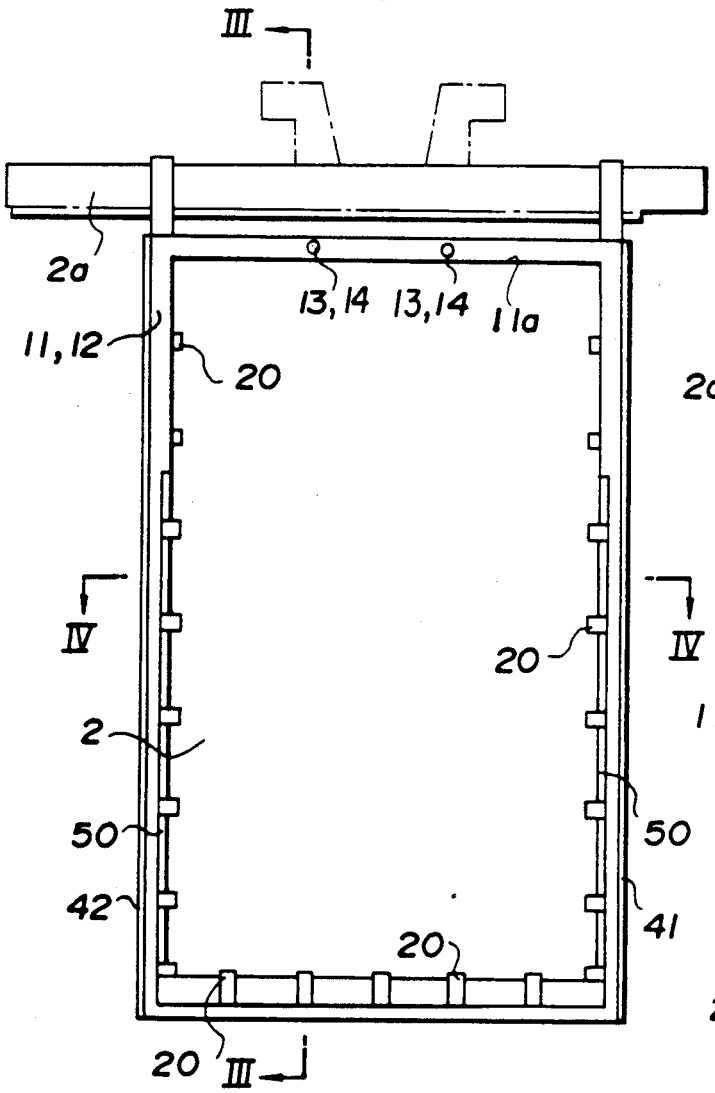
FIG. 2 is an elevational view of a frame body, which holds an anode plate.
Figure 3:
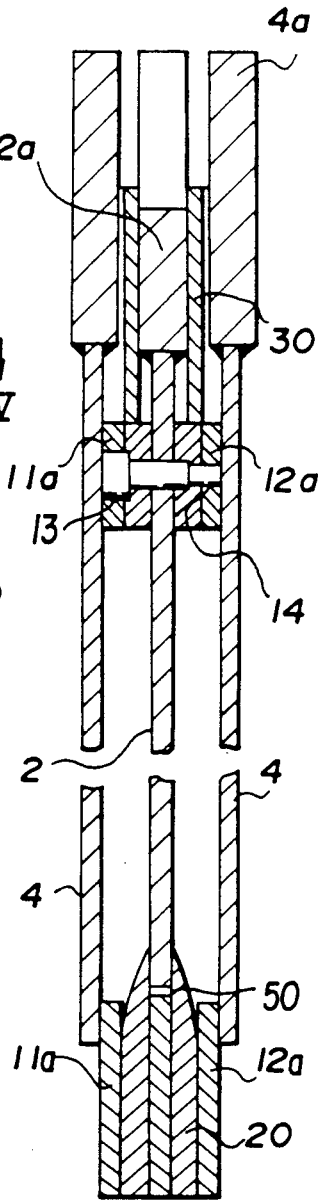
FIG. 3 is a partially cross-sectional elevational view of the frame body as shown in FIG. 2 along the line III—III. In this drawing, cathode plates 4 are also shown.
Figure 4:
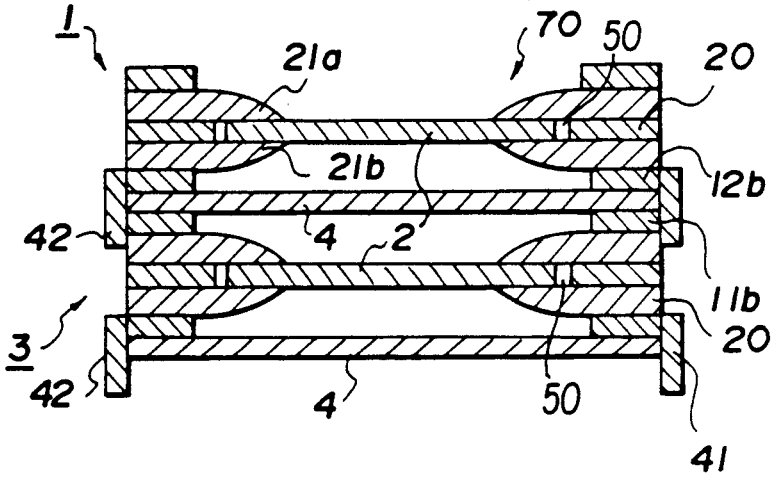
FIG. 4 is a schematic horizontal cross-sectional view of electrode plates assembled by two of the frame bodies along the line IV—IV in FIG. 2.

One of the frame bodies 1, with which an electrode unit is formed, is illustrated in FIGS. 1A and 1B. The assembly of anode plates 2 and cathode plates 4 by means of the frame bodies 1 is illustrated in FIGS. 2–4. A frame body 1 comprises two frames 11, 12 of an insulating material such as a plastic, which hold an anode plate 2, anode fixing means 20 which fix an anode plate 2 to the frame body 1, short-circuiting preventing means 30 which prevent contacting of the electrode plates and an engaging member 40 which engages the frame body 1 with an adjacent frame body.

Figure 5:
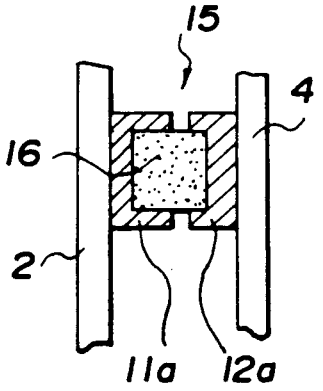
FIG. 5 is a schematic partial cross-sectional view of the upper beam of a frame of the frame body.

The frame body 1 is rectangular so as to enclose an anode plate 2 and comprises the two frames 11 and 12. The frames 11 and 12 respectively comprise horizontal beams 11*a* and 12*a* and vertical beams 11*a* and 12*b*. The space between the vertical beams 11*b*'s is preferably partly a little wider than the width of the anode plate 2 so that a clearance 50 (1–2 cm) is formed between the frame body 1 and the anode plate 2 through which the electrolyte can flow as shown in FIGS. 1A and 2. The horizontal beams 11*a* and 12*a* are provided with bolt holes 13 and 14, respectively with which an anode plate 2 can be fixed to the frame body 1 as shown in FIGS. 1A and 3. This fixing can also be made by welding, if desired. The upper horizontal beams 11*a* and 12*a* may be hollow tubes having vent holes or a slit 15 so that they are packed with a filter material 16 which collect the mist generated from the surface of the electrolytic bath as shown in FIG. 5. That is, oxygen gas, etc. which are produced from the surface of the electrolytic bath diffuses out through the vent holes or slit 15. The mist of the electrolyte which is entrained by the oxygen gas, etc. is collected by the filter 16 packed in the beams, which can be periodically replaced.

The anode fixing means 20 is a pair of resilient clamps 21*a* and 21*b* spacedly secured together at the base and having a clearance (FIGS. 1A and 1B). The edge of an anode plate 2 is inserted therein and clamped by the resilient force thereof. The frames 11 and 12 are preferably designed so that there are some clearances 50 partly provided between the bottoms of the clearance 22 of the anode fixing means 20 and the edge of the anode plate 2 secured by anode-fixing means 20 as shown in FIG. 4. The depth of the clearance 22 is such that the bottom thereof is located at slightly inside of the inner edges of the frames 11 and 12 at the part of the clearance 50 as seen in FIG. 4.

The short-circuiting-preventing means 30 are strips which are protruded from the ends of the upper beams 11*a* and 12*a* in the case of the example illustrated in FIG. 1A. These can be combined in an inverted U shape so that the frame members 11 and 12 can be hung from a cross bar 2*a* (see FIG. 2).

The engaging member 40, which is a pair of strips 41 and 42 projected from both sides of the frame 11, make one frame body 1 engage with another frame body 3 (see FIG. 3) with a cathode plate 4 held therebetween. As shown in FIG. 4, the engaging member 40 holds an adjacent frame body 3 between the strips 41 and 42 and covers the side edges of the cathode plate 4 held between the two frame bodies 1 and 3. If the side edges of the cathode plates 4 are exposed, the object metal deposits thereon and grows to contact the deposit on the adjacent cathode plate 4. This makes difficult the stripping of the deposited object metal. That is, as shown in FIG. 4, an electrode unit is assembled by combining a first frame body 1, a second frame body 3, etc. holding an anode plate 2 by the anode fixing means 20 and holding a cathode plate 4 between the frame bodies 1 and 3 by means of the engaging member 40 (i.e. the strips 41 and 42). It is preferable to clamp the thus formed electrode unit (denoted as 70, see FIG. 9) by means of a pair of clamp bars 71 (seen FIG. 12A), which extend over the whole thickness of the assembled anode plates 2 and cathode plates 4 and secure them by means of claws provided at both ends thereof. The clamp bars 71 are removed when the electrode unit 70 is lifted from the electrolytic cell and transferred to electrode-treating stations.

Figure 6:
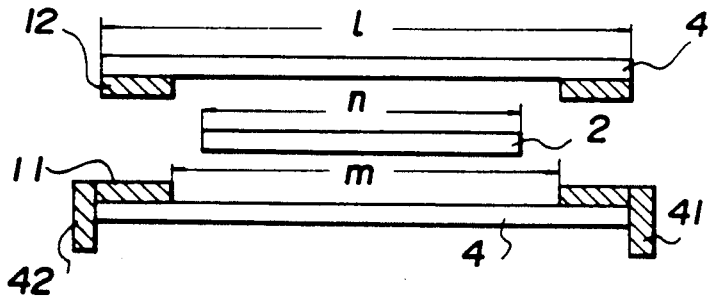
FIGS. 6–8 are schematic horizontal view representing the relation of the sizes of the anode and cathode and the state of the deposition of metal.
Figure 7:
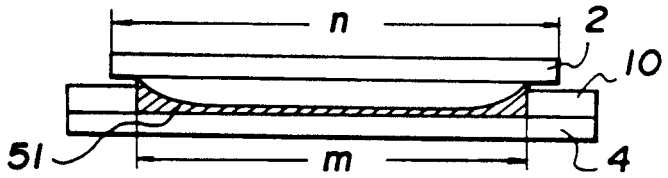
Figure 8:
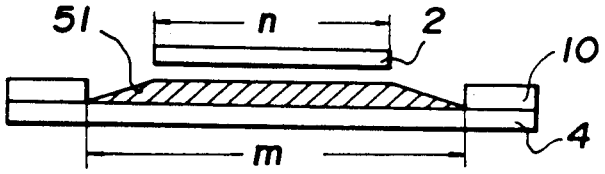

The length of the horizontal beams (11*a* and 12*a*) is approximately the same as the width l (FIG. 6) of a cathode plate 4, and the side peripheries of a cathode plate 4 are covered by the vertical beams 11*b* and 12*b*. Therefore, the width m of the deposition surface of a cathode plate 4 is a one little shorter than the width l of another cathode plate 4 (FIG. 6). If the width m of the deposition surface of the first cathode plate 4 is shorter than the width n of intervening anode plate 2, the periphery of the deposition surface is inside of the side edges of the anode plate 2 as shown in FIG. 7. The electric current density in electrolysis is higher at the side peripheries than the central portion, and thus more metal 51 is deposited at the peripheries as ridges, which may grow to contact the anode plate 2 to cause short-circuiting. On the other hand, if the width m of the deposition surface of the cathode 4 is greater than the width n of the anode plate 2 as shown in FIG. 8, deposition of the metal is thinner at the peripheries, which will make it difficult to insert a scraping knife between the deposited metal 51 and the cathode surface.

In the electrode unit of the present invention, the width m of the deposition surface of the cathode plate 4 is only slightly greater than the width n of the anode plate, and, therefore is free from the difficuly as explained above with respect to FIG. 8.

Figure 10:
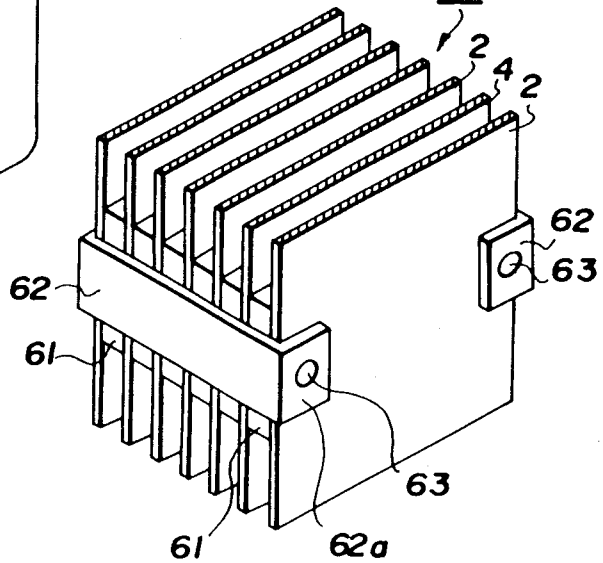
FIG. 10 is a partly broken perspective view of an electrolytic cell in which an electrode unit is mounted.

Another example of the electrode unit of the present invention is illustrated in FIG. 10. The electrode unit 60 comprises a plurality of anode plates 2 and cathode plates 4 alternately assembled with insulating spacers 61 inserted inbetween. The electrode plates are tightly secured by means of a pair of connecting bars 62 which are provided with claws 62*a* having screw means 63.

Figure 9:
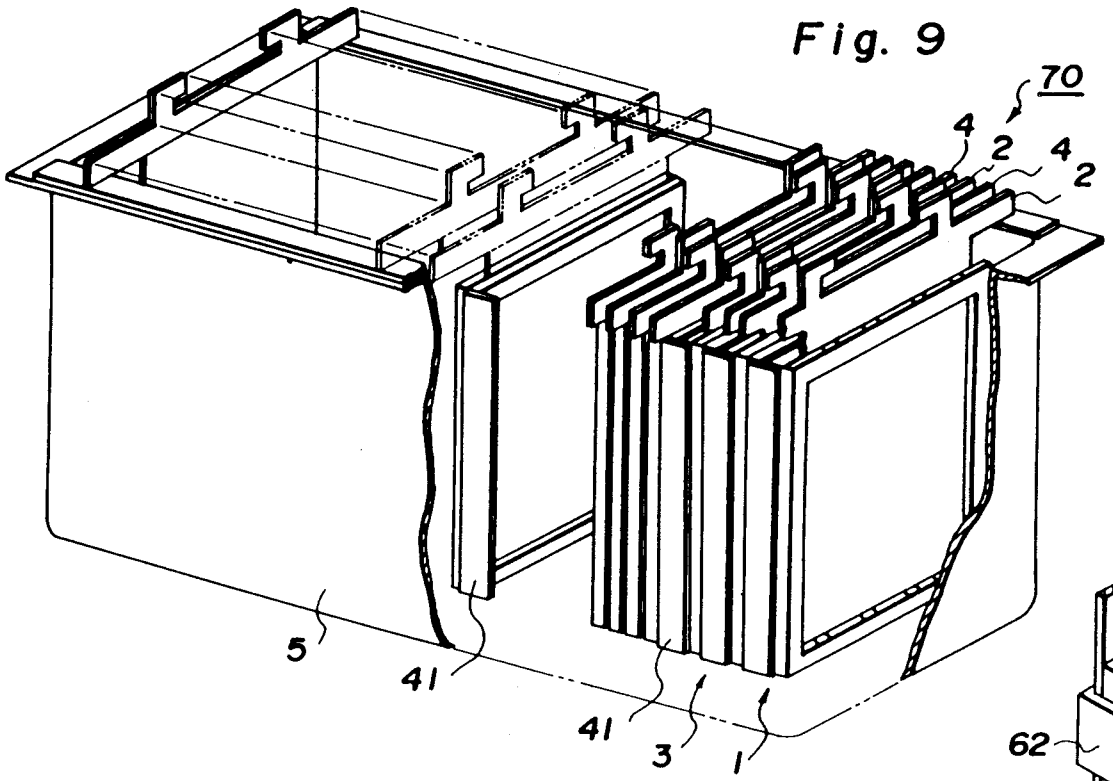
FIG. 9 is a perspective view of another example of the electrode unit.

This electrode unit 60 is immersed in an electrolytic cell 5 as shown in FIG. 9 for electrolysis. After one operation, the electrode unit 60 is lifted and transferred to various treating stations for operations such as stripping of the deposited metal, servicing of the electrodes, etc. by means of a suitable transfer means such as an overhead crane.

Figure 11:
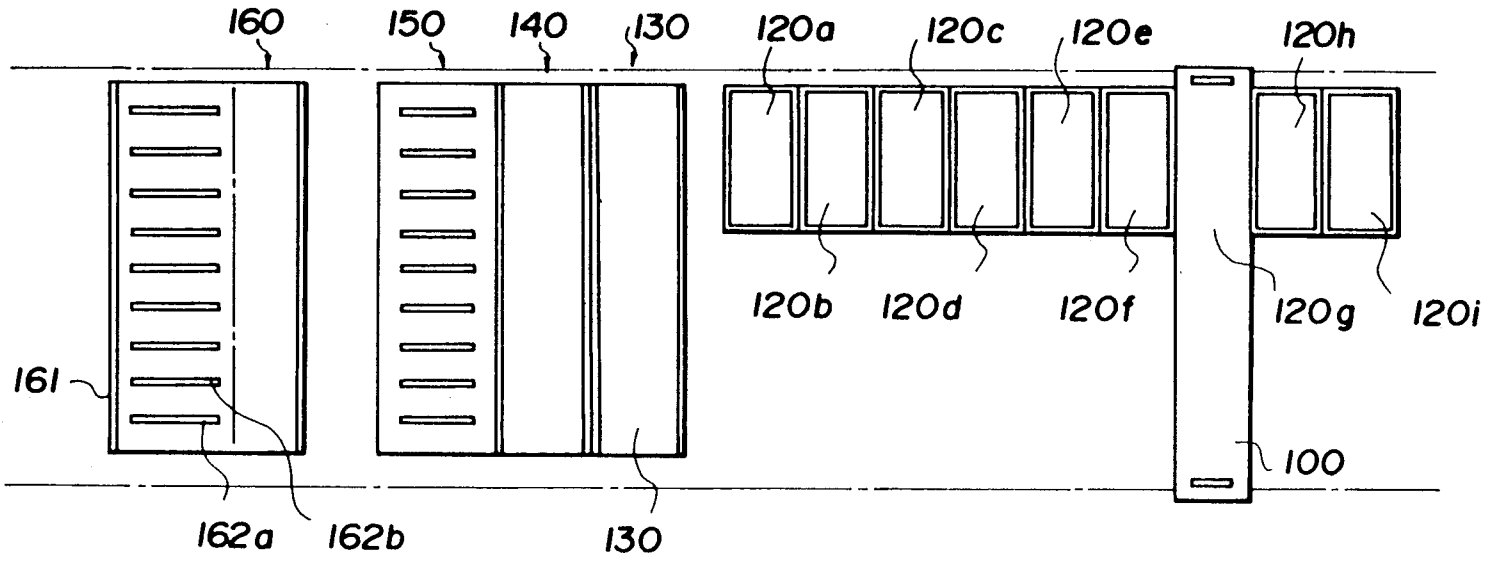
FIG. 11 is a plan view showing the layout of the electrolytic cells and various treatment stations.

An example of the layout of electrolytic cells and various treating stations is shown in FIG. 11. In this example, electrolytic cells 120*a*, 120*b*, . . . , an anode plate servicing station 130, a cathode plate washing station 140, a cathode plate polishing station 150, a stripping station 160, etc. are arranged along the travelling course of a transfer means 100.

Figure 12A:
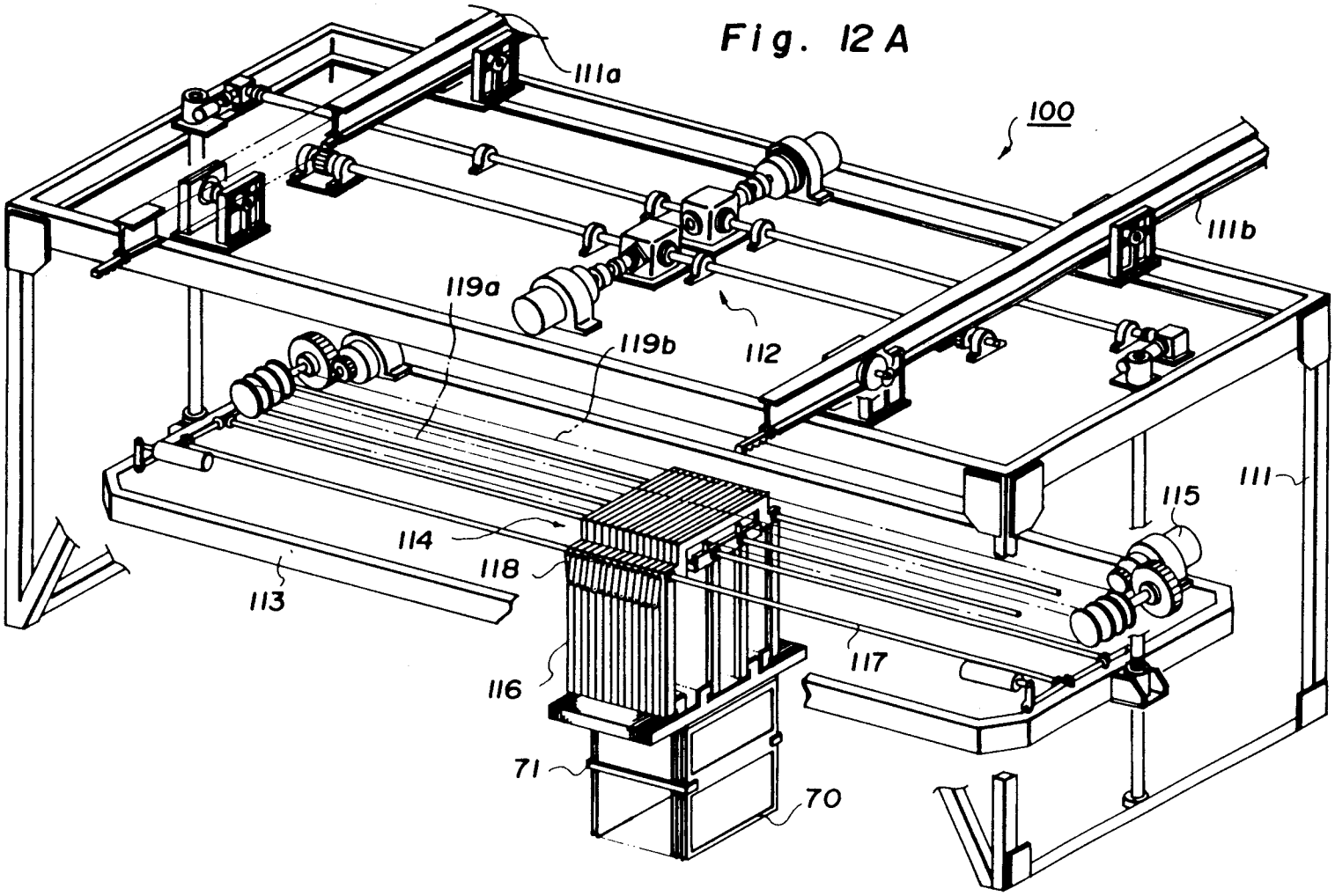
FIGS. 12A and 12B are schematic perspective views showing an example of the electrode-handling apparatus.
Figure 12B:
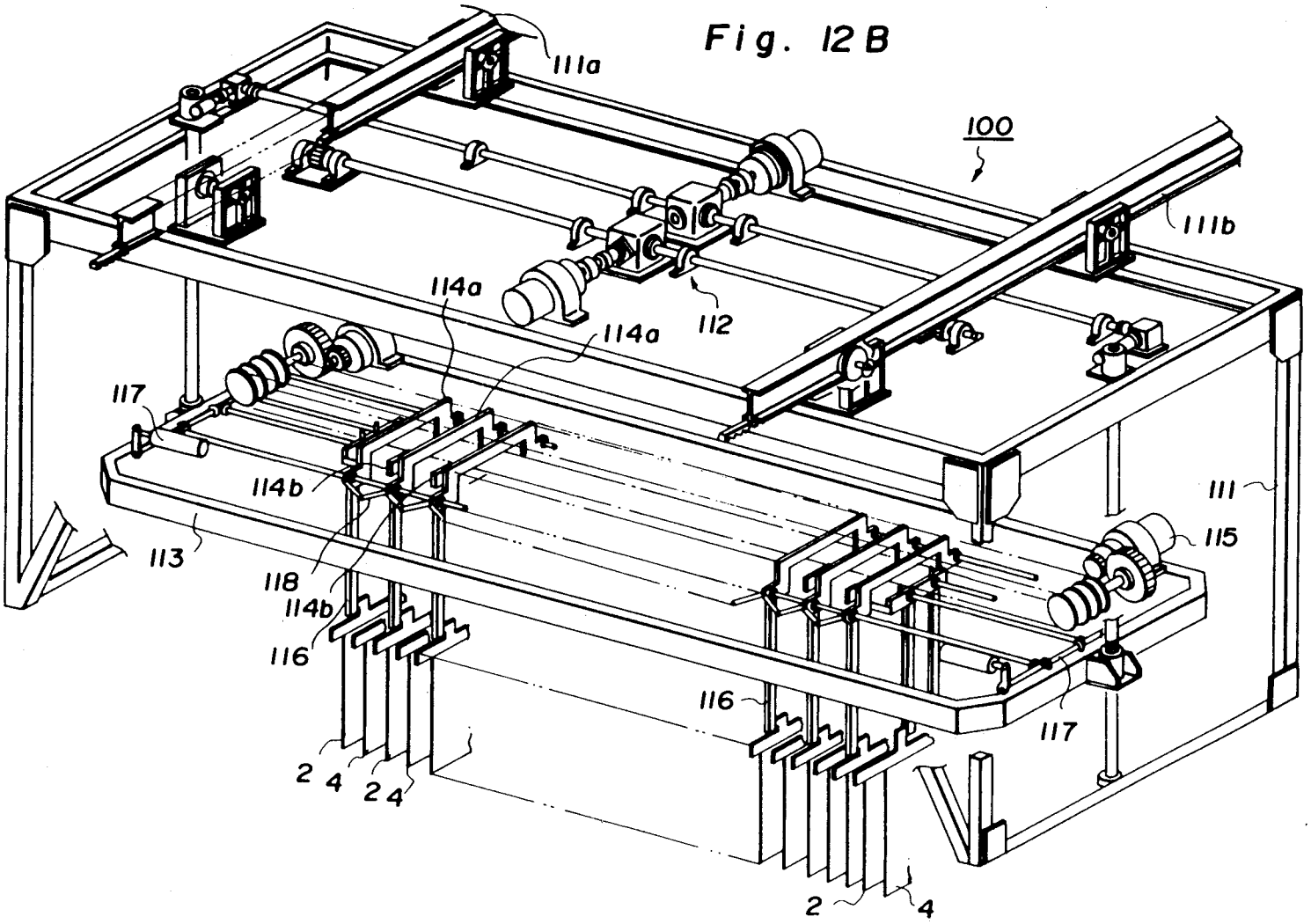

A suitable transfer means 100 is illustrated in FIGS. 12A and 12B. The apparatus comprises a travelling general framework 111, a driving mechanism 112 for the framework 111, a hanger-supporting frame 113 which is mounted on the framework 111 and can be lifted and lowered, a plurality of hangers 114 which are mounted on the hanger-supporting frame 113 and are movable along the beams of the hanger-supporting frame 113, a hanger-driving mechanism 115 which displace the hangers 114, spacing them apart or bringing them together, tilting hook members 116 suspended from the hangers 114 and catch the ears of the electrode plates 2, 4 and a hook-driving mechanism 117 which operates the tilting hook members to catch or release the electrode plates 2, 4. The framework 111 travels suspended from overhead rails 111*a* and 111*b*, for instance, or otherwise travels on rails laid on the plant floor. The hangers 114 and the hanger-supporting frame 113 are insulated by insulating members inserted therebetween. There are outside hangers 114*a* which hang anode plates 2 and inside hangers 114*b* which hang cathode plates 4.

The hangers 114*a* and 114*b* are serially connected by links 118, and there is provided on the hanger-supporting frame 113 chain mechanisms 119*a* and 119*b*, one of which moves the hangers 114 in one direction and the other of which moves the hangers 114 in the opposite direction. By the movement of the two chain mechanisms, 119*a*, 119*b* the hangers 114 connected by the links 118 are spaced apart (that is, expanded), or brought together.

The transfer apparatus explained hereinabove is a subject matter of the copending patent application (Ser. No. 179,402 now U.S. Pat. No. 4,851,098) filed on the same date by the same assignee and described in detail therein.

From one of the eletrolytic cells (FIG. 10), an electrode unit is lifted by the transfer apparatus. Clamp bars (if used) and frame bodies which have assembled the electrodes are removed (during the travelling, for instance), the hangers are displaced and the inter-electrode space is widened, and the electrode plates 24 are transferred to an anode-servicing station. For example, the assembled electrodes of which the inter-electrode space is 15–30 mm can be separated to 150–250 mm.

Figure 14:
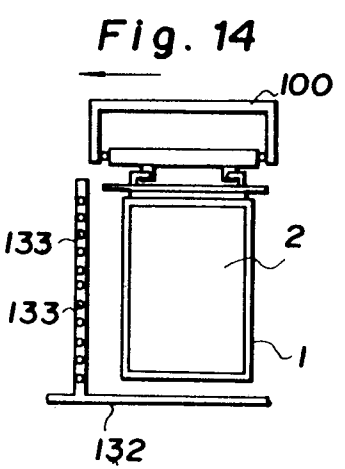
FIGS. 13 and 14 are a schematic elevational view and a schematic side view of an anode-servicing apparatus.
Figure 13:
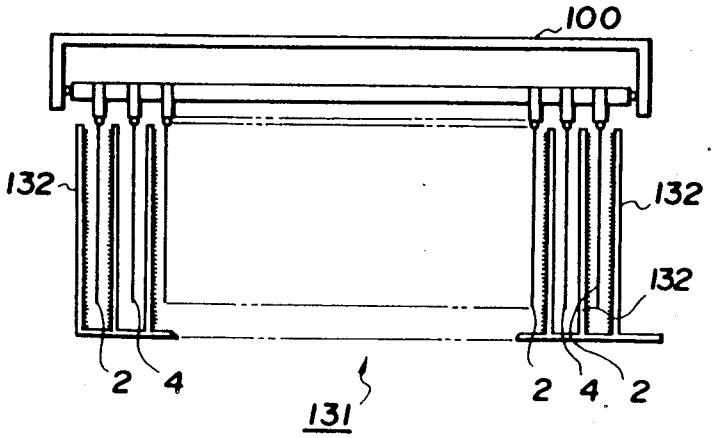

At the anode plate servicing station 130 (FIG. 11), anode crusts are removed. An example of an anode-servicing apparatus 131 is illustrated in FIGS. 13 and 14. The illustrated anode servicing apparatus 131 comprises a plurality of spacedly positioned vertical spray pipes 132 having a series of spray nozzle orifices. The distance between the adjacent spray pipes 132 is equal to the distance between an anode plate 2 and the adjacent cathode plate 4 when the linked hangers 114 are most expanded, and the spray nozzle orifices are provided on the side of the spray pipes 132 facing the anode plates 2. Therefore, the anode and cathode plates 2, 4 suspended widest apart from the transfer apparatus respectively can pass through the space between the adjacent spray pipes 132 and the anode plates 2 and the frames are washed with high pressure jets of water from the nozzle orifices. This operation can be automatically controlled by means of sensors and related automatic control devices. The anode plates are held by their frame bodies 132 and, therefore, the anode plates 2 are satisfactorily protected from deformation which they may otherwise suffer during the servicing operation. That is, the method of this invention eliminates the need to repair electrodes which have been bent by accident.

The cathode plates 4 can be washed while they pass the cathode plate working station 140, which is constructed in the same manner as the above-described anode servicing apparatus 131. The cathode plates 4 are preferably washed with hot water.

Needless to say, servicing of the anode plates 4 and the cathode plates 2 can be simultaneously effected by providing nozzle orifices on both sides of the spray pipes 132 on the anode servicing apparatus 131.

The anode plates 2 and the cathode plates 4 suspended from the transfer means 10 which have been washed by the anode servicing apparatus 131 and a cathode servicing apparatus are transferred to the stripping station 160. At the stripping station 160, the cathode plates 4 which are suspended from the transfer means 100 together with the anode plates 2 under the widest-spaced condition are subjected to a scraper 161. The scraper 161 is provided with a plurality of scraping knives **162*a*, 162*b*, 162*c*, ect. so that a plurality of cathode plates 4 can be stripped. The distance between a cathode plate 4 and another adjacent cathode plate 4 is set to be the same as the distance between a scraping knife 162*a* and another scraping knife 162*b* (FIG. 11). Stripping is effected as the electrode plates 2 and 4 are suspended from the transfer means 100**.

In a preferred embodiment, the clearance 50 between the edge of the anode plate 2 and the edge of the frame beams is not provided at the upper part of the frame 10 as seen in FIG. 2. By forming the frame so, the state as shown in FIG. 7 is partly caused in the upper part of the cathode plate 4. This makes easy insertion of a scraping knife 162. That is, a knife edge can easily inserted at the point where the deposited metal layer has a steep (not inclined) edge.

As has been explained, stripping can be effected while the electrode plates 2 and 4 are suspended from the transfer means 100. As the distance between a cathode plate 4 and the adjacent anode plate 2 is extended to 150–250 mm as mentioned above, stripping can be performed by the conventional scraper means without hindrance from the neighboring anode plate 2.

After the deposited metal (zinc for example) has been scraped off from the cathode plates 4 the electrodes 2 and 4 are transferred to the cathode polishing station 150. The polishing of the cathode plates 4 is also performed while the anode plates 2 the cathode plates 4 and are suspended from the transfer means 100. In this step, polishing brushes, etc. can be provided without difficulty because the distance between a cathode plate 4 and the adjacent anode plate 2 is 150–250 mm, as mentioned before.

Figure 16:
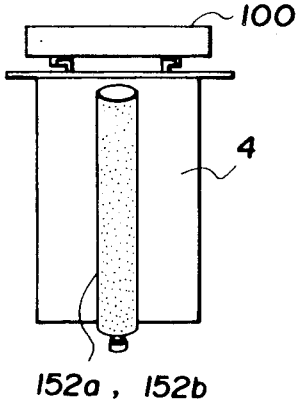
FIGS. 15 and 16 are a schematic elevational view and a schematic side view of a cathode-polishing apparatus.
Figure 15:
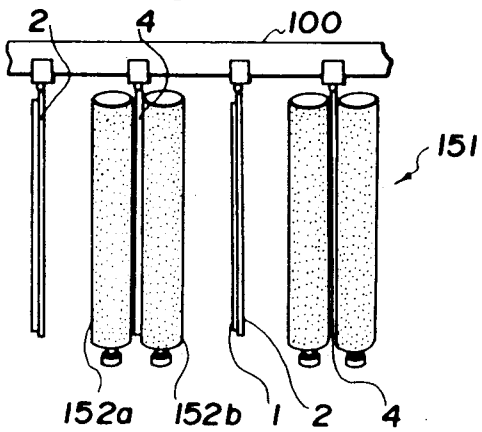

An example of a cathode polishing device 151 is shown in FIGS. 15 and 16. The cathode polishing devices 151 is a pair of closely positioned rotatable vertical cylindrical brushes **152*a* and 152*b* provided at the positions of the cathode plates 4 when they are suspended the most extendedly. Thus the cathode plates 4 pass through the pair of rotating brushes 152*a*, 152*b* as the transfer means 100 travels. The direction and rate of rotation of the brushes 152*a*, 152*b* can be regulatable in accordance with the direction and velocity of the travelling of transfer means 100**.

After the treatments of the electrode plates 2, 4 are finished (and, if the frame bodies have been removed, they are fixed to the anode plates 2 again, and the electrode plates 2 and 4 are again brought together by the movement of the hangers), the bundle of the electrode plates 2, 4 tightened before or during the transfer means 100 travels to an electrolytic cell 5. The pair of clamp bars are fixed to the bundle of the tightened electrode plates 2, 4 to form an electrode unit again, and the thus reassembled electrode unit is immersed in an electrolytic cell 5.

In the method of electrowinning a metal, the number of the electrodes assembled into a unit or the number of units handled in a cycle of operation is arbitrary. One preferred example is as follows. The electrodes to be used in an electrolytic cell are formed into two units. While one unit of the electrodes are used for electrowinning, the other unit of the electrodes can be treated outside of the cell, and the half space of the electrolytic cell where the electrode unit has previously been immersed can be cleaned with electrolytic current maintained while the electrodes of the unit are treated. That is, anode sludge, etc. can be drawn out by suction.

A series of procedures in the method of the present invention can be automated by means of automatic control mechanisms provided in the respective treating devices and the transfer apparatus. These automatic control mechanisms of course comprises sensors, control logic circuits, etc. which are usually used.

In the method of the present invention, it may suffice if washing of the electrodes and the removal of crusts are carried out once per several electrolysis runs.

Although the above embodiment of the present invention has been described with respect to the arrangement of apparatuses shown in FIG. 11, the method of the present invention can be carried out with other arrangement of the apparatuses. Devices for washing, servicing, etc, of the electrode plates are not limited to the embodiments described above and shown in the drawings.

We claim:

1. In a method of electrowinning a metal wherein a metal is deposited on cathode plates and the cathode plates are transferred to another station by transfer means to be subjected to treatments such as stripping of deposited metal, polishing, and washing, the improvement comprising:

(a) using at least one electrode unit which comprises a plurality of anode plates and cathode plates alternately, insulatedly, and separably assembled;

(b) carrying out immersion and lifting of said at least one electrode unit into and from an electrolytic cell unit by unit;

(c) disassembling said at least one electrode unit after said at least one electrode unit is lifted to be subjected to said treatments as said plurality of anode plates and cathode plates are held by said transfer means; and (d) thereafter assembling said plurality of anode plates and cathode plates again as said at least one electrode unit.

2. The method of electrowinning a metal as claimed in claim 1, wherein a series of procedures of lifting of said plurality of anode plates and cathode plates from said electrolytic cell, electrode treatments, and immersing said at least one electrode unit again in said electrolytic cell are continuously carried out as said plurality of anode plates and cathode plates are simultaneously held by said transfer means.

3. The method of electrowinning a metal as claimed in claim 1 or claim 2, wherein:

(a) said at least one electrode unit is assembled by means of frame bodies;

(b) said at least one electrode unit is disassembled after said at least one electrode unit is lifted from said electrolytic cell and during or after transfer;

(c) the separated anode plates with said frame bodies and cathode plates are simultaneously suspended and subjected to various treatments; and (d) after said plurality of anode plates and cathode plates are assembled again, they are immersed in said electrolytic cell as a unit.

4. The method of electrowinning a metal as claimed in claim 3, wherein:

(a) said frame bodies are removed from said plurality of anode plates after said at least one electrode unit is lifted from said electrolytic cell and (b) said frame bodies are fixed to said plurality of anode plates before said plurality of anode plates and cathode plates are assembled again.

5. An electrode unit comprising:

(a) a plurality of frame bodies, each one of said plurality of frame bodies comprising:

(i) a pair of rectangular frames provided with a plurality of clamp means held between said pair of rectangular frames, said clamp means being sized, shaped, and positioned to grip the opposing faces of an anode plate, and (ii) a pair of engaging strips each perpendicularly projecting from the outer edge of a vertical beam of one of said pair of rectangular frames;

(b) a plurality of anode plates, each one of said plurality of anode plates being held by said plurality of clamp means of an associated one of said plurality of frame bodies; and (c) a plurality of cathode plates, each one of said plurality of cathode plates being sandwiched between two adjacent ones of said plurality of frame bodies such that end surfaces of each one of said plurality of cathode plates are covered by said two adjacent ones of said plurality of frame bodies, thereby preventing metal from being deposited on said end surfaces.

6. An electrode unit as claimed in claim 5, wherein:

(a) a plurality of fixing members each of which comprises a pair of said clamp means are provided sandwiched between said pair of rectangular frames and (b) each one of said pair of engaging strips projects from a corresponding one of the two side edges of one of said pair of rectangular frames and extends toward an adjacent frame body to receive a cathode plate therebetween.

7. An electrode unit as claimed in claim 6, wherein clearances are provided at the bottom periphery and part of the side peripheries of each one of said plurality of frame bodies.

8. An electrode unit comprising:

(a) a pair of vertical elongated members, each one of said pair of vertical elongated members being provided with a plurality of clamp means sized, shaped, and positioned so as to grip one side edge of an anode plate;

(b) a strip means projecting from the side of each one of said pair of vertical elongated members opposite to the associated anode plate to be gripped along the length of said pair of vertical elongated members in the direction perpendicular to the projecting direction of said clamp means; and (c) a cathode plate sandwiched between said pair of vertical elongated members such that end surfaces of said cathode plate are covered by said pair of vertical elongated members, thereby preventing metal from being deposited on said end surfaces.

9. An electrode unit comprising:

(a) a pair of vertical elongated members, each one of said pair of vertical elongated members being provided with a plurality of clamp means sized, shaped, and positioned so as to grip a side edge of an anode plate;

(b) a strip means projecting from the side of each one of said pair of vertical elongated members along the lengths of said pair of vertical elongated members in the direction perpendicular to the projecting direction of said clamp means; and (c) a cathode plate sandwiched between said pair of vertical elongated members such that end surfaces of said cathode plate are covered by said pair of vertical elongated members, thereby preventing metal from being deposited on said end surfaces.

10. An electrode unit comprising:

(a) a plurality of rectangular parallelepipedal anode plates (2), each one of said plurality of rectangular parallelepipedal anode plates (2) having two faces and four edges and each one of said plurality of rectangular parallelepipedal anode plates (2) having at least approximately the same dimensions;

(b) a plurality of rectangular parallelepipedal cathode plates (4), each one of said plurality of rectangular parallelepipedal cathode plates (4) having two faces and four edges and each one of said plurality of rectangular parallelepipedal cathode plates (4) having at least approximately the same dimensions;

(c) a plurality of pairs of frames (11, 12) made of an insulating material, each frame in each one of said plurality of pairs of frames (11, 12) having approximately the same outside dimensions as said plurality of rectangular parallelepipedal cathode plates (4);

(d) a plurality of resilient clamps (20) which are U-shaped in cross section and which are held between each one of said plurality of pairs of frames (11, 12), each one of said plurality of resilient clamps (20) being sized, shaped, and positioned to grip the opposing faces of one of said plurality of rectangular parallelepipedal anode plates (2) while leaving a clearance (50) between the adjacent edge of said one of said plurality of rectangular parallelepipedal anode plates (2) and the bottom of the U of said each one of said plurality of resilient clamps (20), said clamps (20) and said frames (11, 12) being sized, shaped, and positioned so that the bottoms of the U's of said clamps (20) are slightly inside of the inner edges of said frames (11, 12);

(e) means (13, 14) for holding each pair of frames (11, 12) together so as to grip a plurality of said resilient clamps (20) therebetween; and (f) a plurality of engaging strips (41, 42) mounted on one frame (11, 12) in each of said pair of frames (11, 12), said plurality of engaging strips (41, 42) being sized, shaped, and positioned to engage a frame (11, 12) in the adjacent pair of frames (11, 12) and to hold one of said plurality of rectangular parallelepipedal cathode plates (4) therebetween.

* * * * *